United States Patent [19]

O'Keefe

[11] 4,003,237

[45] Jan. 18, 1977

[54] MULTIPLE STATION FORMING PRESS WITH BLANK ACCELERATOR

[75] Inventor: George F. O'Keefe, Waterbury, Conn.

[73] Assignee: Textron, Inc., Providence, R.I.

[22] Filed: Oct. 23, 1975

[21] Appl. No.: 625,047

[52] U.S. Cl. ..... 72/405; 72/421

[51] Int. Cl.[2] ..... B21D 43/05

[58] Field of Search ..... 72/421, 405, 419, 404

[56] References Cited

UNITED STATES PATENTS

| | | | |
|---|---|---|---|
| 2,283,505 | 5/1942 | Longfield | 72/405 |
| 3,369,387 | 2/1968 | Bradlee | 72/421 |
| 3,862,564 | 1/1975 | Blase | 72/405 |

*Primary Examiner*—C.W. Lanham
*Assistant Examiner*—Gene P. Crosby
*Attorney, Agent, or Firm*—DeLio and Montgomery

[57] ABSTRACT

A multiple station forming press is disclosed for feeding blanks from station to station for successive die forming operations. The transfer mechanism is designed to receive an over-size blank at the first station and to transfer it a greater distance than the actual reciprocating travel of the tranfer bar, by means including an auxiliary carrying block on the transfer bar and drive linkage adapted to move the auxiliary block relatively to the transfer bar.

9 Claims, 6 Drawing Figures

36
35
49
48
47
51
42'
42''
50
52
53
57
41
56
40
43
45
W
37
44
58
59
V
VI

MULTIPLE STATION FORMING PRESS WITH BLANK ACCELERATOR

This invention relates to presses and more particularly to presses of the type having a plurality of forming stations where work pieces are successively acted on by forming tools (e.g., punches) carried on a row of reciprocating plungers, which cooperate with a row of complementary dies.

In a conventional system of this type the distance between stations is constant and the work piece size is limited by the size of the blank which will fit within a given distance, determined by the spacing of the stations. Since substantial reductions are normally effected at the second station, the limitation on part size is usually a function of the blanking capacity, at the first station. If larger blanks could be fed to the forming stations, a greater range of work piece sizes could be formed by a given press.

A known type of transfer bar, clearly shown in Bradlee U.S. Pat. No. 3,369,387, FIGS. 3 and 4, comprises an elongated flat bar traversed throughout the width of the plunger array by a longitudinal slot, the sides of which are provided with pairs of fingers for gripping the work pieces at each station and one end being formed with a generally circular socket to receive a cut blank, when the socket is centered at the first station, all the stations being equidistantly spaced. (In the cited patent the transfer bar is arranged to feed blanks from both ends toward a delivery station in the middle.) The blanking plunger at the first station is programmed to cut a blank after the socket has been returned to the first station and while the work pieces are being stripped from the plungers; the maximum diameter of the blank is therefore limited by the maximum diameter of the work piece at the second station, since no overlapping could be tolerated.

It is accordingly an object of the present invention to provide a press wherein the transfer mechanism is adapted to receive and convey work piece blanks which are larger than normal.

It is a further object of the invention to provide a generally conventional transfer bar with an auxiliary blank carrying block, movable relatively to the transfer bar, to receive and advance a large blank.

It is another object of the invention to provide a transfer bar and relatively movable auxiliary transfer block with actuating means adapted to determine the relative positions and movement of said bar and block as a function of the movement of the transfer bar in the machine.

It is a still further object of the invention to provide certain improvements in the form, construction and arrangement of the several parts whereby the above named and other objects may effectively be attained.

The invention accordingly comprises the features of construction, combination of elements, and arrangement of parts which will be exemplified in the construction hereinafter set forth, and the scope of the invention will be indicated in the claims.

The foregoing objects are attained by adding to the conventional transfer bar, in the vicinity of the first station, a blank carrying block, slidable on the transfer bar and connected thereto by a link disposed at a variable angle to the line of movement, the link bearing a cam follower controlled by an angled cam track on the machine bed, such that reciprocating movement of the transfer bar along its normal path causes the angle of the link to be varied and thus moves the block on a longer path. This enables the block to accommodate an over-size blank and to transfer it from the first station where it is cut to the second station where it is subjected to its first forming step. The distance between the center lines of the first and second stations is greater than the normal travel distance of the transfer bar and corresponds to the latter distance plus the length of travel of the auxiliary carrying block relative to the transfer bar.

A practical embodiment of the invention is shown in the accompanying drawings wherein.

Figure 1:
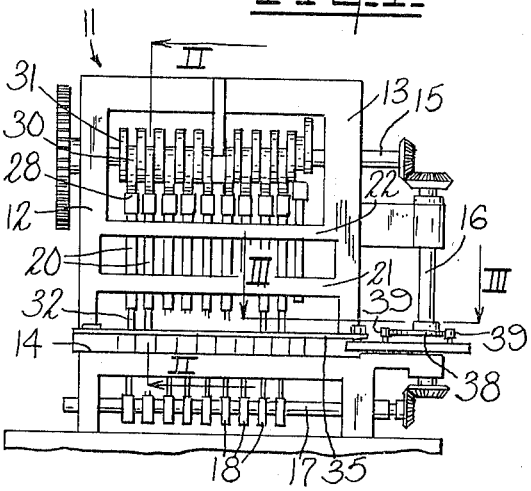
FIG. 1 represents a somewhat diagrammatic side elevation of a press of the type in which the transfer mechanism can be used.
Figure 2:
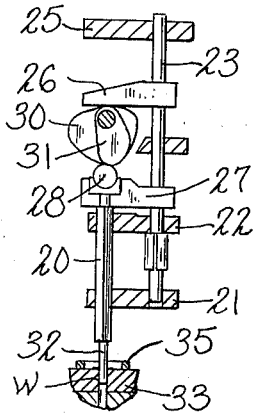
FIG. 2 represents a vertical section on the line II—II of FIG. 1 showing the basic elements at a single forming station.
Figure 3:
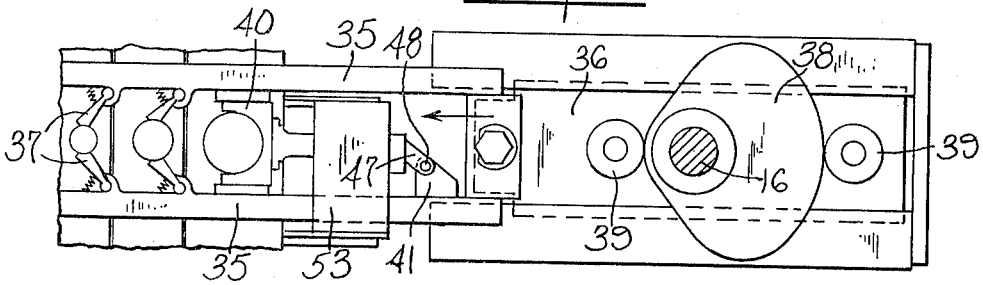
FIG. 3 represents a detail horizontal section on the line III—III of FIG. 1 showing the transfer mechanism and its drive cam, parts being broken away.
Figure 6:
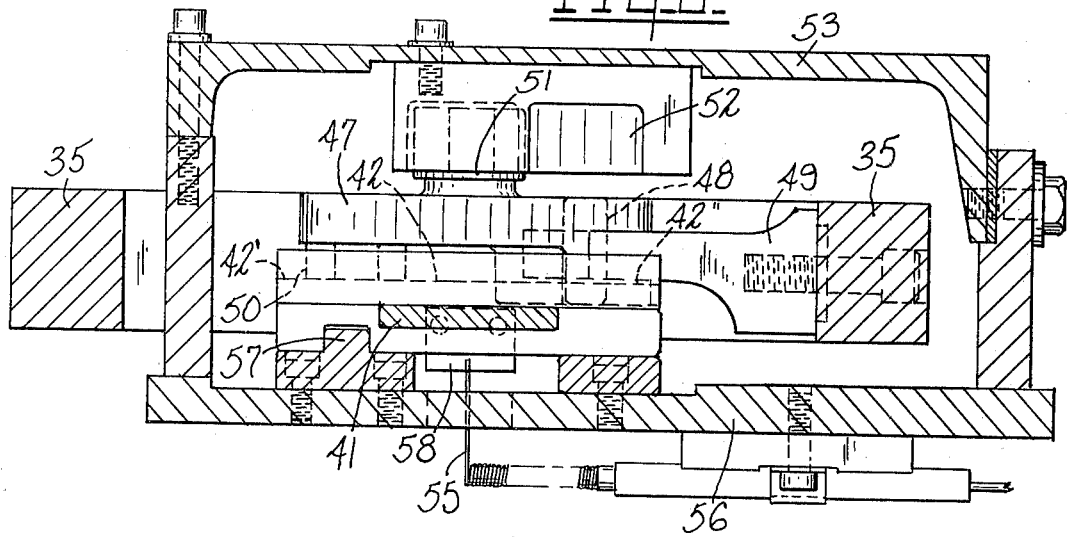
FIG. 6 represents a detail vertical section on the line VI—VI of FIG. 5, on a larger scale.
Figures 4, 5:
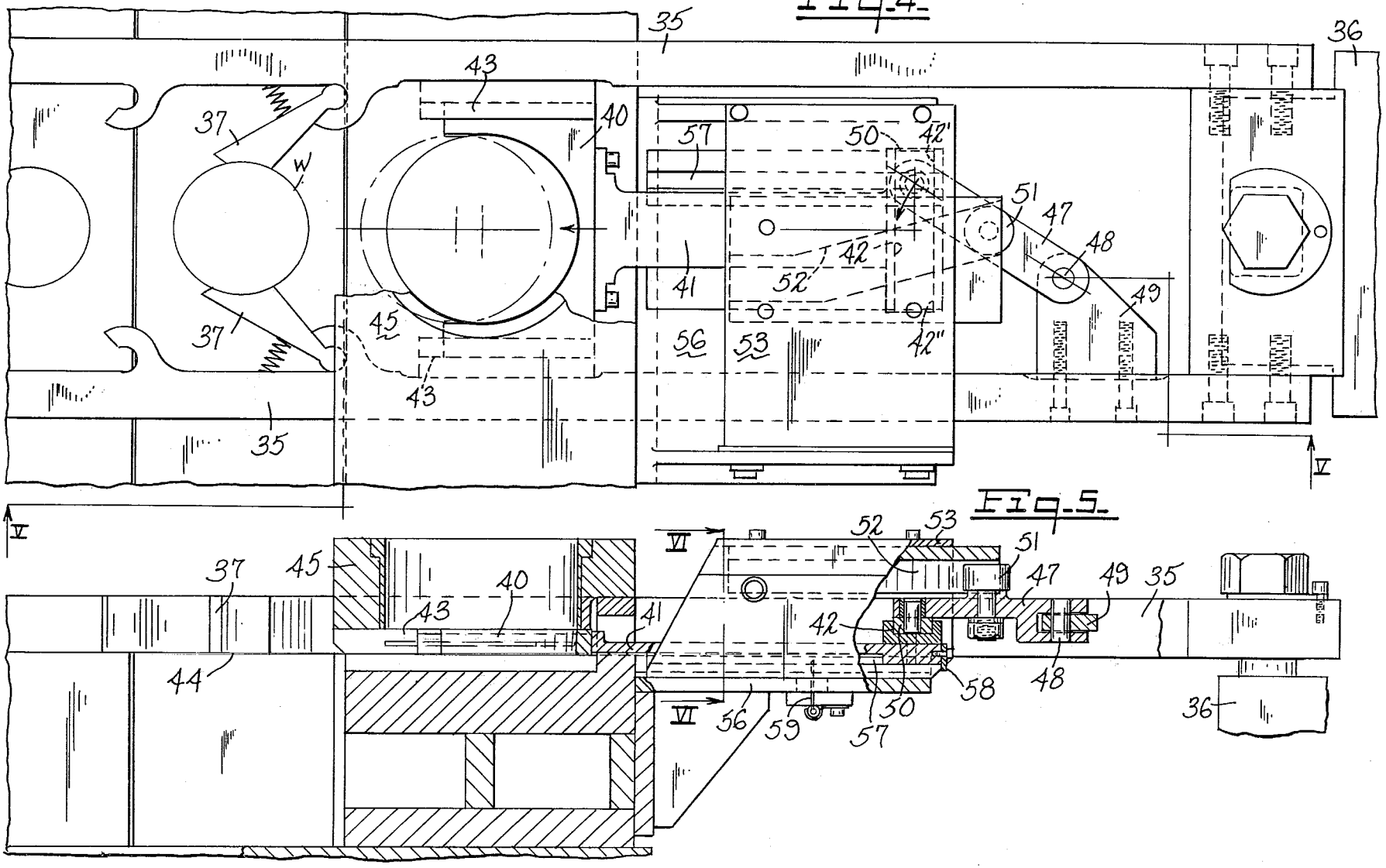
FIG. 4 represents a top plan view, on a larger scale, of the transfer bar, auxiliary carrying block and operating means for the latter, parts being broken away.
FIG. 5 represents a vertical section on the line V—V of FIG. 4, parts being in elevation and parts being broken away.

Referring to the drawings, the press comprises a frame 11 having upright ends 12, 13 and a die bed 14. A main cam shaft 15 is journaled in the ends 12, 13 driving, through bevel gears, a vertical side shaft 16 which, in turn, drives the knockout shaft 17 carrying knockout cams 18, and a plurality of plungers 20 are journaled in horizontal frame elements 21, 22, for vertical movement. Each plunger has an associated lifter rod 23, journaled in frame elements 22 and 25, and carrying a lifter arm 26 and horizontal yoke 27. The upper end of each plunger is engaged with a corresponding yoke 27 and is provided with a cam follower roller 28. The cam shaft carries a pair of cams for each plunger, the cam 30 being a lifter cam, acting on the underside of the arm 26, and the cam 31 being the downstroke plunger cam, acting on the roller 28. As shown in FIG. 2, a punch 32 is mounted on the lower end of the plunger and is engaged in the work piece W within the die 33. The position of the transfer bar is indicated at 35 and the knockout pin, actuated by a cam 18, for removing the work piece from the die is conventional and not shown.

The transfer bar assembly, according to the invention, comprises the transfer bar 35, fixed to its drive plate 36 and provided with pairs of work piece engaging fingers 37. Reciprocating sliding movement of the transfer bar is effected by means of the cam 38 on shaft 16 driving cam follower rollers 39 on the drive plate 36, which plate is traversed by the shaft.

The auxiliary carrying block assembly comprises the carrying block 40 fixed to a bracket 41 which has a track 42 disposed transversely across its rear end. The block 40 slides through a passage 43 in the transfer bar 35. The bottom of the block 40 lies in the plane 44 of the tops of the dies at subsequent stations.

The carrying block drive includes a link 47 pivotally mounted at 48 on a bracket 49 which is fixed on one side of the transfer bar 35, the forward end of the link being provided with a slide 50 adapted to run in the track 42. The layout of the parts just described is such that, when the carrying block is in a position closest to the bracket 49 (as a reference point), the link 47 lies at an angle of about 32° from the line of travel of the block, with the slide 50 near the end 42' of the track 42; when the block is advanced away from the bracket 49 the link lies substantially parallel to the line of travel and the slide 50 is near the opposite end 42'' of the track 42. Movement between these positions is effected by means of a cam follower 51 mounted on the upper side of the link 47 and engaging in a downwardly facing track 52 carried by a bridge 53 which is fixed on the machine frame and extends across the transfer bar and block assemblies. The track 52 lies at an acute angle to the line of travel of the block, such that movement of the transfer bar and block toward the loading position (to pick up a blank from the first station) causes the follower 51 to move laterally, increasing the angle between the link 47 and the line of travel, moving the slide 50 toward the end 42' of the track 42, which corresponds to the position where the block is closest to the bracket 49. As the transfer bar and block are moved in the opposite direction, to advance the work pieces (and a new blank), the follower 51 also moves in the opposite direction, drawing the link toward parallelism with the line of travel, moving the slide 50 toward the end 42'' of the track 42 and causing the block to move along the transfer bar away from the bracket 49.

A probe 55 is mounted on the bottom of the support 56 for the transfer bar slide 57 and is adapted to be engaged by the trip plate 58 on the rear of the transfer bar, to monitor the correct reciprocatory movement of the transfer bar.

From the foregoing description of the functions of the elements in connection with their form and interrelation it will be apparent that reciprocation of the transfer bar in the normal manner along a path equal to the spacing of the stations will effect movement of the auxiliary blank carrier block along a path which is longer by the amount of movement of the block on the transfer bar. In a typical installation, a transfer bar having a throw of 5.5 inches, corresponding to the spacing of stations 2 through $2+n$, may carry an auxiliary carrier block which moves 0.75 inches, in the same sense as the bar, as the link 48 oscillates and reciprocates the slide 50 in its track 42. The carrier block will thus have an absolute travel distance of 6.25 inches and the first station will be spaced this distance from the second station so that substantially larger blanks can be cut and fed to the second station for forming.

While the over-travel carrier block is shown and described as being embodied in a press adapted to feed blanks in one direction, from a first cutting station to a delivery point at the opposite end of the press, it will be evident that such blocks and their operating mechanism could, if desired, be installed on each of the ends of the transfer bar in a double strand feed press of the type shown in Bradlee U.S. Pat. No. 3,369,387, cited above, to feed over-size blanks thereto for a limited number of forming operations.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

What I claim is:

1. A machine tool for forming metal articles from blanks cut from a strip of metal fed into the machine, said machine comprising in combination, a frame, a tool set mounted in said frame and including an array of plungers having punches mounted thereon and mating dies adapted to form work pieces fed to said dies, blank cutting means adjacent one end of said array of plungers and dies, transfer means mounted in said frame for sequentially advancing through said array of plungers and dies metal blanks cut by said cutting means, auxiliary blank carrying means supported on said transfer means and movable longitudinally thereof and actuating means adapted to move said blank carrying means relatively to said transfer means.

2. A machine tool according to claim 1 wherein the blank carrying means is provided with a first track extending transversely of its line of movement, the actuating means includes a link pivoted at one end to the transfer means and provided at its other end with means slidable in said first track and means fixed to the frame for varying the positions of said link, the means fixed to the frame including a second track extending at an acute angle to the line of movement of the transfer means, and the link being provided with means slidable in said second track, the last named means being mounted on the link intermediate the ends thereof.

3. A machine tool according to claim 1 wherein the distance between the center of the blank cutting means and the center of the adjacent plunger and die set is greater than the distance between any two adjacent plunger and die sets.

4. A machine tool according to claim 3 wherein the blank carrying means is adapted to carry a blank larger than the blanks normally supplied by the transfer means.

5. A machine tool according to claim 1, wherein said actuating means includes a link extending between the transfer means and the blank carrying means, and means fixed to the frame for varying the positions of said link.

6. A machine according to claim 5 wherein the link has a sliding engagement with the blank carrying means and is provided with a cam follower intermediate its ends, the means fixed to the frame including a track adapted to receive said cam follower.

7. A machine tool according to claim 5 wherein the blank carrying means is provided with a first track extending transversely of its line of movement, and the link is pivoted at one end to the transfer means and is provided at its other end with means slidable in said first track.

8. A machine tool according to claim 5 wherein the means fixed to the frame includes a second track extending at an acute angle to the line of movement of the transfer means, and the link is provided with means slidable in said second track.

9. A machine tool according to claim 8 wherein the last named means is mounted on the link intermediate the ends thereof.

* * * * *